United States Patent [19]

Farque

[11] 4,241,332

[45] Dec. 23, 1980

[54] PERSONAL SECURITY ALARM

[75] Inventor: Anthony Farque, Fayetteville, Ark.

[73] Assignee: Body Guard, Inc., Springdale, Ark.

[21] Appl. No.: 9,657

[22] Filed: Feb. 5, 1979

[51] Int. Cl.[3] ..... G08B 7/00; G08B 5/00

[52] U.S. Cl. ..... 340/326; 340/321; 340/327; 340/331; 340/371; 340/384 E; 362/186; 362/363

[58] Field of Search ..... 340/326, 327, 331, 371, 340/75, 88, 321, 332, 328, 384 E; 362/186, 202, 363

[56] References Cited

U.S. PATENT DOCUMENTS

| | | | |
|---|---|---|---|
| 2,809,366 | 10/1957 | Van Boort et al. | 340/75 |
| 3,786,498 | 1/1974 | Lipe et al. | 340/326 |
| 3,898,514 | 8/1975 | Takahashi | 340/384 E |
| 4,101,880 | 7/1978 | Haus | 340/326 |

*Primary Examiner*—John W. Caldwell, Sr.
*Assistant Examiner*—James J. Groody
*Attorney, Agent, or Firm*—Robert R. Keegan

[57] ABSTRACT

A personal security alarm including a loud speaker powered by an audio frequency signal generator to produce a siren effect and a high intensity flashlamp, both of which are activated upon operation of a remote switch and can be deactivated only by a key switch on the alarm. A generally conical transparent plastic extension from the center of the loud speaker horn encloses the flashlamp and also disperses the sound. Preferably the high voltage power for the flashlamp is derived from a transformer supplied with the audio frequency signal provided to the loud speaker.

12 Claims, 4 Drawing Figures

PERSONAL SECURITY ALARM

The present invention relates to a personal security alarm which produces a piercing audible alarm together with periodic brilliant flashes of light from a Xenon flashlamp. It is to be used for personal security, primarily in the home but possibly in other places, to permit the occupant to produce an attention getting alarm, in the event of intrusion, threatened intrusion or other emergency. The alarm will not only serve to alert neighbors or other persons to summon aid but also may have the effect of deterring or frightening away an intruder.

Alarm systems providing audible or visible light emissions or both are, of course, known. However, previous such alarms have not been adapted to the purpose of providing a small relatively unobtrusive personal security alarm which may be used in the home without the necessity for complicated installation procedures.

The apparatus of the present invention is internally powered by readily available dry cell batteries; it is nearly impossible to silence once activated except by being turned off with a key provided to the user. It is of rugged construction and will continue to operate unless subjected to the most violate destructive measures.

The personal security alarm light flasher augments the audible alarm particularly at night and when placed in proximity to a window. The visible flash alarm has the added advantage that it facilitates location of the source of the alarm more readily than from the audible alarm only. The flashing intense light also increases the probability that the intruder will be frightened away or otherwise deterred from his threatened intrusion.

The structure of the alarm is such that the audible alarm unit and the visible alarm unit are integrated in a compact package which is relatively unobtrusive in its inactive state and is not by any measure unsightly. The compact integrated nature of the combination visible and audible alarm also contributes to the economy with which the alarm can be produced.

In addition to providing the above described features and advantages it is an object of the present invention to provide a combined visible and audible alarm in which structural elements are utilized for the dual purpose of transmitting and broadcasting both light and sound emissions.

It is another object of the present invention to provide a visible and audible alarm in which elements of the electronic circuitry are utilized both to generate the audio frequency signal to power a siren loud speaker and to generate a high voltage direct current pulse to power a Xenon flashlamp producing the visual alarm.

It is still another object of the present invention to provide a personal security alarm activated by a push button remote from the main alarm structure and capable of being deactivated only by a key switch and further having a reduced power test position for testing the audible alarm.

Further objections and advantages of the present invention will be apparent from consideration of the following description in conjunction with the appended drawings in which.

Figure 2:
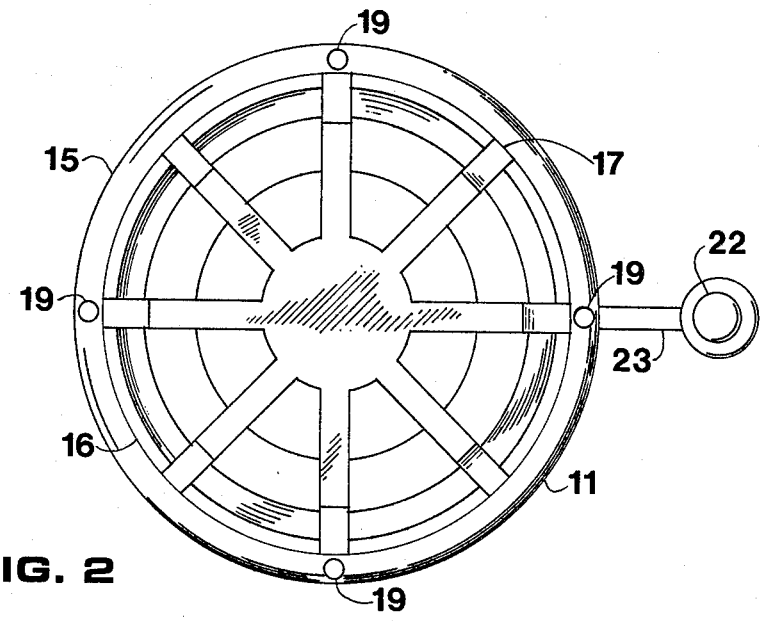
FIG. 2 is a top plan view of the apparatus of FIG. 1.
Figure 1:
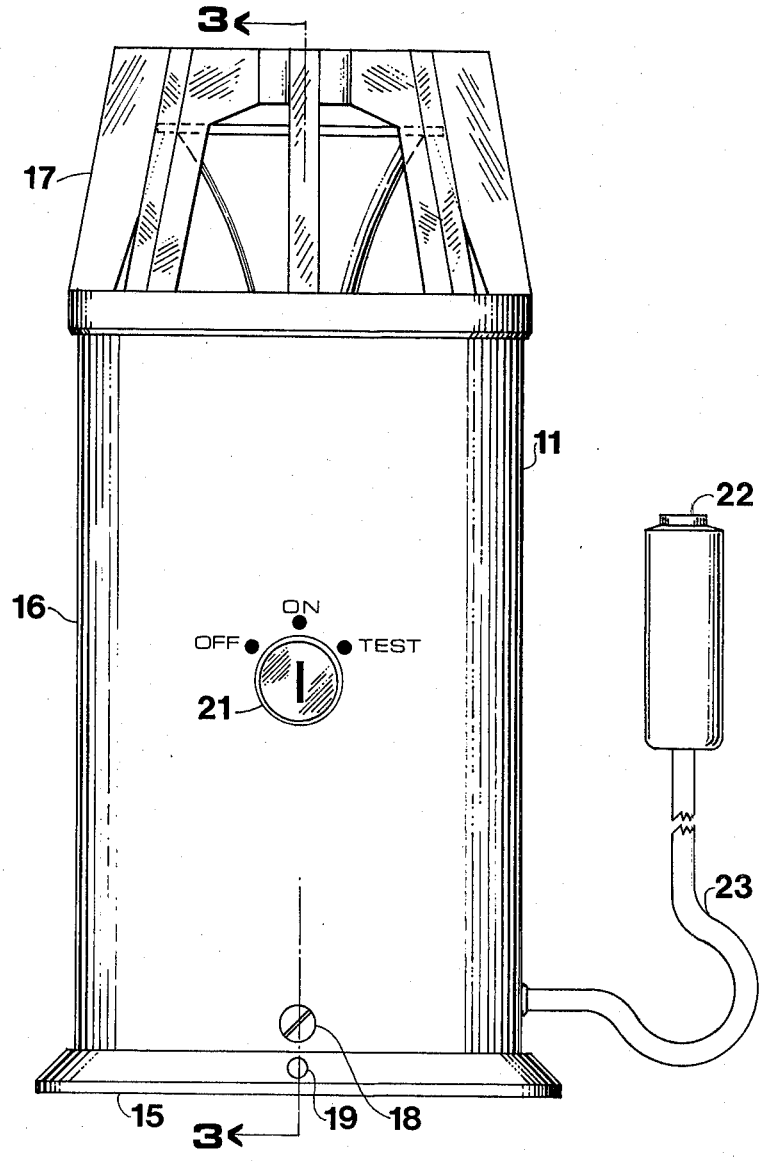
FIG. 1 is a front elevational view of an alarm according to the invention.

Referring now to the drawings and particularly FIGS. 1 and 2, a personal security alarm 11 is shown having a base 15, a case 16 and a plastic lens 17 (of clear polycarbonate, Lexan for example), forming the top part of the alarm housing.

Figure 3:
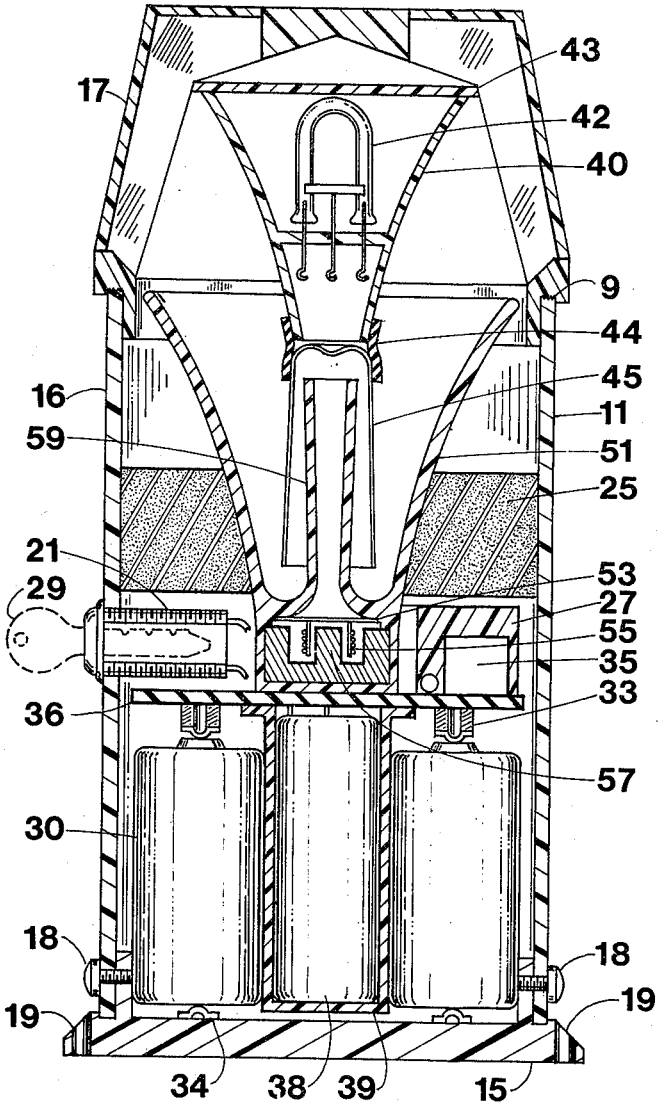
FIG. 3 is a sectional view of the apparatus of FIG. 1 taken along the line 3—3 in FIG. 1.

As seen more clearly in FIG. 3 the base 15 is removable and is held in place by screws 18. In some instances the personal alarm will be screwed or bolted to a wall, a ceiling or some large difficult-to-move object. To facilitate such installation holes 19 are provided around the periphery of base 15 for convenient mounting of the alarm on a wall surface or other surface.

Base 15 and case 16 are preferably formed of a high impact plastic (such as polyvinylchloride 1120/1220 or acrylonitrile butadiene styrene), or from moderately heavy gauge metal such as aluminum or steel in order that the alarm will resist all but the most violate attack and remain in operation.

An alarm button switch 22 is provided to activate the alarm and is connected by a two conductor cable 23 of the interior of case 16. As will later be explained once the alarm is initiated it cannot be cut off by any manipulation of the alarm switch button 22 or by breaking or short circuiting cable 23. Cable 23 will preferably be 20 to 30 feet long so that it may be kept at hand any place in the room or possibly in some cases moved from room to room. As an alternative to the switch 22 and cable 23 a small radio transmitter unit may be substituted as means for activating the alarm. A receiver would then be provided in case 16. The switch and cable arrangement as shown in FIG. 1 is, however, quite satisfactory and has the advantage of being more economical to produce. The alarm may also be provided with an alternate or additional switch suitable to attach to a door or window and be operated by opening of the door or window.

In the side of case 16 is a key switch 21 preferably having three positions, "OFF", "ON", and "TEST". As will later be described key switch 21 is a conveniently key operated switch equivalent to a double pole double throw center off switch. Switch 21 is used to run the alarm to the "ON" or "ARMED" condition and also to operate the test circuit which permits one to activate the flashlamp and the siren for test purposes.

Figure 4:
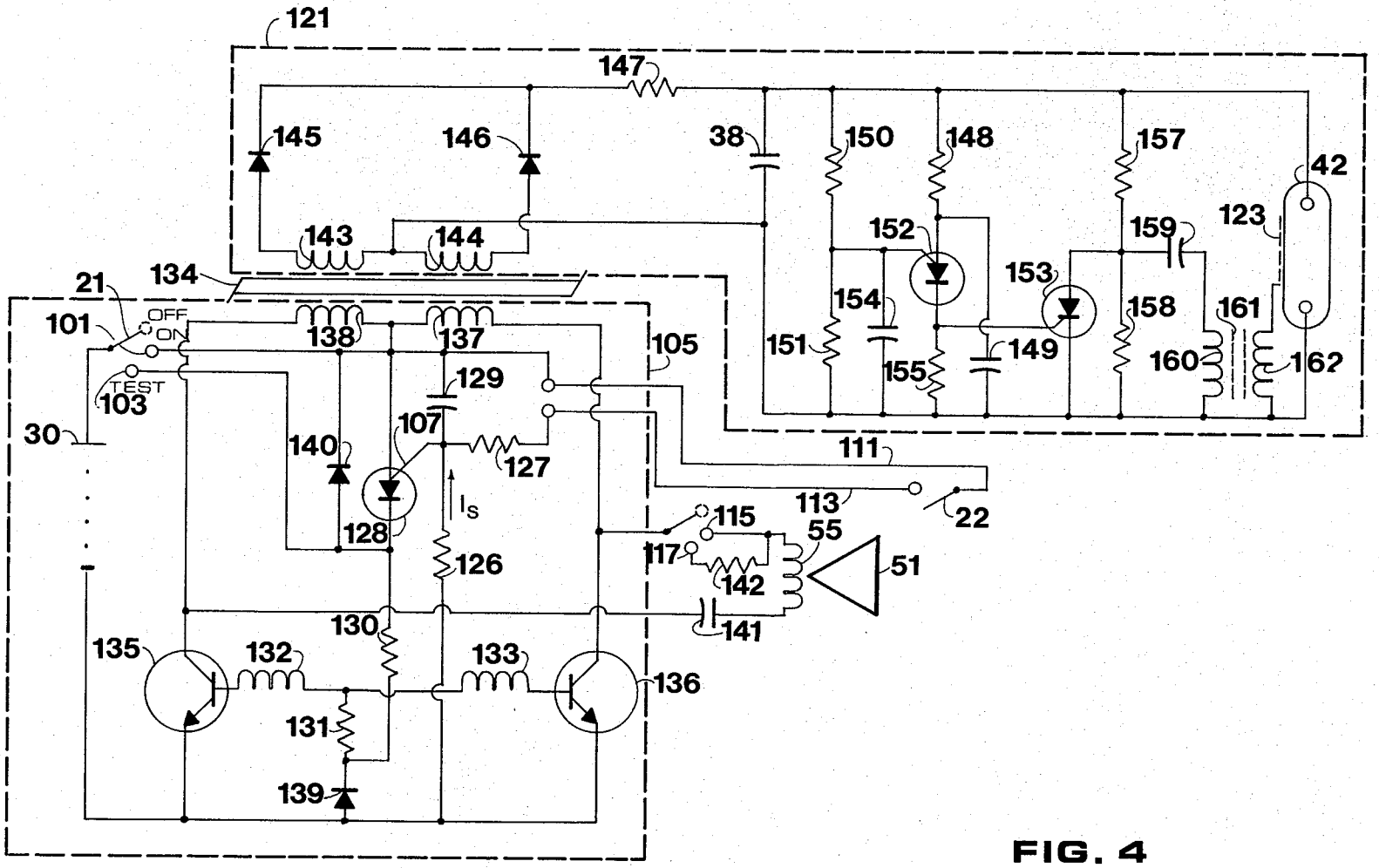
FIG. 4 is a schematic diagram of the electrical circuit of the alarm according to the invention.

Referring especially to FIG. 3, the general arrangement of the components in the illustrated embodiment of the invention is shown; as previously mentioned the base 19 is removable for access to the interior of the alarm unit and particularly to replace batteries 39 which are positioned in the bottom of case 16; the battery positions are six in number and are provided with fixed blade contacts 34 for the negative battery contacts and spring blade contacts 33 for the positive battery contacts. Blade contacts 33 and 34 are interconnected and connected to the electrical circuitry by electric conductors not shown in FIG. 3. Electrical components are preferably mounted on a printed circuit card 36; the components are identified by reference numbers 35 in FIG. 3 without specific identification and only for general illustration of the circuit components position in the unit. The component may be encased in a body of potting compound 27. Details of the electronic circuitry are shown in FIG. 4 and will later be explained with reference thereto.

Centrally mounted in an upright position in the alarm unit is a loud speaker 51 of the conventional folded reflex horn, permanent magnet type. The physical characteristics and hence the audio characteristics of the speaker 51 are modified by a transparent near-conical transparent plastic element 40. The transparent plastic element 40 is secured in a co-axial arrangement with the speaker by securing it to the center portion 45 of the reflex horn. This is conveniently accomplished in the illustrated embodiment by a section of rubber tube 24 into which the horn center portion 44 and the bottom of plastic element 40 are both a snug force fit. Speaker 51 is firmly but resiliently retained in placed by a resilient toroid 25 of sponge rubber, plastic or other material.

The plastic element 40 also serves to protect a flash tube 42 which is mounted therein. The top of plastic element 40 is closed by a clear plastic disc 43 which serves to further protect the flash tube 42.

The structure of loud speaker 51 is conventional and is not shown in great detail. Speaker 51 comprises a diaphram 53, a speaker coil 55 and a speaker permanent magnet 57.

The electrically produced small excursions of diaphram 53 are efficiently coupled into the air by means of a folded reflex horn 59 having the previously described center portion 45. The folded reflex horn 59 provides a sound wave path of gradual increasing cross-sectional area for efficient acoustic coupling in accordance with known acoustic design techniques.

Plastic member 40 is shaped to produce an extension of the reflex acoustic horn and being given an appropriate shape may increase the acoustical coupling between diaphram 53 and the air; at the same time the curved shape of plastic element 40 modifies the radiation pattern of speaker 51 whereby the acoustical energy from speaker 51 is re-directed from what would be a conical beam radiating upward to a generally ommi-directional pattern with a far greater horizontal component of directivity.

It will be understood that the flashing light of the alarm emanates from flash tube 42 and the light is effectively transmitted through plastic element 40 and a reinforced transparent plastic lens 17. Due to the configuration of the alarm unit and especially the acoustic directivity of plastic element 40 the source of sound appears to the ordinary observer to be substantially coincident with the source of light. This feature of the apparatus provides a very compact unit which is desirably configured from both a practical and esthetic point of view.

The electrical circuit and its operation can best be understood by reference to the schematic diagram of FIG. 4. The positive terminal of battery 30 is connected to key switch 21, shown in the OFF position in FIG. 4. It will be noted that in the OFF position there is an open circuit for the battery and consequently no battery drain.

When key switch 21 is turned to the ON position a circuit is completed to contact 101. The subcircuit 105 shown within the dashed lines is a solid state inverter arranged to remain passive so long as switch 22 is closed. With switch 22 normally closed a very small current on the order of ten microamps flows through resistor 126, resistor 127, switch 22, and contact 101 back to battery 30. Resistor 127 is not essential to normal operation of the circuit but serves to limit current from static discharges from the operators body or in the event of a fault within the circuit. A programmable unijunction PNPN transistor 128 has its gate lead 107 connected to the positive end of resistor 126.

The capacitor 129 is effectively across the contacts of switch 22 and its value determines how quickly transistor 128 latches when switch 22 is opened. That is, the current through resistor 126 will continue momentarily upon the opening of switch 22 for the time required to charge capacitor 129. It is not desirable to have transistor 128 latch very quickly (on the order of milliseconds) because it would then detect brief openings of switch 22 caused by shock or vibration and would also be subject to turn on by static discharges.

Capacitor 129 must be charged from nearly zero voltage to about 0.7 volts to latch transistor 128. This delay is governed in a conventional manner by the RC time constant of resistor 128 and capacitor 129 (affected only slightly by resistor 127).

When transistor 128 turns on due to charging of capacitor 129 a current flows through resistor 130 and the circuit of one or the other of transistors 135 or 136. Current through this circuit and resistor 130 biases unijunction transistor 128 so that it can no longer be turned off even though switch 22 is reclosed again drawing current through resistor 126 and away from the gate of transistor 128.

Once transistor 128 is latched a current flows through resistor 130 and resistor 131 through the base windings 132 and 133 of transformer 134 and through the base emitter junctions of transistors 135 and 136 which starts the inverter oscillating with transistors 135 and 136 alternately driven into saturation by positive feedback created by the coupling between each transistor primary collector winding 137 and 138 and each respective secondary base winding 133 and 132. Essentially square wave voltages are thereby produced at the collectors of transistors 135 and 136 with a 180 degree phase relationship across the base windings 132 and 133. When the voltage at the base of either transistor 135 or 136 is positive, a base current flows through that base, base winding 132 or 133, resistor 131, and finally diode 139 which provides the return path for the circuit.

The value of resistor 131 determines the magnitude of the base current. Once started, the inverter continues to oscillate at a frequency determined by the applied voltage, the number of turns of windings 137 and 138 of transistor 134 and by the saturation flux density of the magnetic material in the core of the transformer. For a given application, the frequency of oscillation may be determined by choosing the number of turns of windings 137 and 138. Normally an appropriate audio frequency (2500 Hz for example) would be selected for the oscillator to power the speaker 51.

As previously noted the entire operation and hence the audible and visible alarm cannot be terminated by closing switch 22 or by severing the leads 111–113 to switch 22. Key switch 21 must be returned to the OFF position to terminate operation of the circuit of FIG. 4 and of the alarm.

A TEST position is provided on key switch 21 which permits the circuit to be closed from the battery 30 to the contact 103. When switch 21 is in the ON position as previously described the output of the inverter is supplied through contact 115 of switch 21 to the coil 55 of speaker 51 with a return path through capacitor 141. However, when switch 21 is in the TEST position the circuit connection to speaker 51 is through contact 117 and resistor 142 thereby causing the sound output of the speaker 51 to be substantially diminished when switch 21 is in the TEST position.

Placing switch 21 in the TEST position to contact 103 also has the effect of activating the alarm without the necessity for opening switch 22 as a connection is made from battery 30 positive voltage to the positive side of resistor 130 bypassing transistor 128. Contact 103 is also connected through diode 140 to the aniode of transistor 128 and its various gating circuit components. Preferably the circuit being arranged as shown will permit the key switch 21 to be turned from the TEST position to the ON position without causing the inverter to be activated in the ON position. Alternatively the circuit may be arranged so that it is necessary to turn the alarm to the OFF position after the TEST position before returning it to the ON position. As a further alternative to the arrangement of FIG. 4 contacts 101 and 103 may be connected together and the connection to the cathode of transistor 128 (and diode 140) removed. In this arrangement the only difference between the TEST position and the ON position is the insertion of resistor 142 in the speaker circuit in the TEST position. With this arrangement it is necessary to press the button switch 22 to carry out the test as well as turning the key switch 21 to the TEST position; this arrangement, however, has the advantage of testing the cord and switch as well as the internal electronic apparatus of the alarm.

As previously explained speaker 11 is actuated by the alternating current flowing through speaker coil 17. This current is shaped to give optimum performance from the speaker coil 17 by capacitor 141 which differentiates the square wave voltage between the collectors of transistors 135 and 136.

Subcircuit 121 provides a high voltage pulse power supply for flashlamp 42. When the inverter circuit 105 is oscillating a high voltage (approximately 300 volts) substantially square wave appears across windings 143 and 144 which is rectified by diodes 145 and 146 to charge capacitor 38 through resistor 147. Capacitor 38 stores the energy from the inverter over an interval of some tenths of a second and releases that energy into the Xenon flash tube 42 in an interval of millionths of a second thereby creating an intense brief flash of light.

After each flash capacitor 38 is discharged and resistor 147 is placed in the circuit to prevent capacitor 38 then appearing as an undesirable short circuit in the secondary of transformer 134. The rate at which the Xenon flash tube 42 is excited is determined by the RC time constant of a circuit consisting of resistor 148 together with capacitor 149.

Capacitor 149 charges until the voltage across the capacitor 149 exceeds by about 0.7 volts the few tens of volts established by a resistive voltage divider consisting of a resistor 150 and a resistor 151; at this time unijunction transistor 152 latches and discharges capacitor 149 into the gate cathode junction of SCR (thyristor) 153.

Capacitor 154 serves to filter the voltage of the voltage divider and prevent erratic timing due to electrical noise. Resistor 155 stabilizes the circuit against leakage from unijunction transistor 152 and SCR 153 gate.

A second voltage divider formed by resistor 157 and resistor 158 establishes a voltage of hundreds of volts on capacitor 159 through the primary winding 160 of trigger transformer 161. SCR 153 is initially nonconducting but when unijunction transistor 152 discharges capacitor 149 into the gate of SCR 153, it also latches and discharges capacitor 159 through the primary winding 160 of the trigger transformer 161 generating a high voltage (thousands of volts) across the secondary winding 162 of the transformer 161. This high voltage is applied to the trigger electrode of the Xenon flash tube 42 which had previously been withstanding the full voltage of capacitor 38 across its main electrodes. The voltage pulse on the trigger electrode 123 of flash tube 42 causes the gas of the flash tube to ionize and initiate conduction between the main electrodes, discharging the electrical energy stored in capacitor 38 and energizing the flash tube 42 to emit a short, bright flash of light. Once capacitor 38 is discharged and current ceases to flow in Xenon flash tube 42 the entire cycle begins anew.

From the previous description those skilled in the art will have no difficulty in constructing the various subcircuits employed in the invention. It will be understood that other subcircuits than those specifically shown in FIG. 4 may be employed to achieve the same result. Notably a different form of oscillator may be used or a different form of high voltage source for the Xenon lamp may be used. One significant feature of the electronic apparatus of FIG. 4 resides in the fact that the oscillator serves both as a powerful audio frequency signal source for the loud speaker converting it into a siren and at the same time provides an alternating current source from the DC (battery) power supply in order that its low voltage may be transformed to the high levels required to power the Xenon flashlamp.

The following Table 1 sets forth exemplary identifications and resistance or capacitance values for the components utilized in the circuit of FIG. 4.

TABLE 1

| REF. NO. | CIRCUIT ELEMENT | VALUE OR CHARACTERISTICS |
|---|---|---|
| 30 | 6 Batteries, carbon-zinc | 9 Volt total |
| 38 | Capacitor | 300 μf 350V |
| 129 | Capacitor | 6.8 μf 3V |
| 141 | Capacitor | 5 μf 50V |
| 149 | Capacitor | 1 μf 25V |
| 154 | Capacitor | 0.1 μf 50V |
| 159 | Capacitor | 0.01 μf 500V |
| 139 | Diode | 1A 50V |
| 140 | Diode | 1A 50V |
| 145 | Diode | 500 μA 1000V |
| 146 | Diode | 500 μA 1000V |
| 42 | Flash Tube, Xenon | 300V 50 Watt-sec. |
| 126 | Resistor, ohms | 1M ¼W |
| 127 | Resistor | 1K ¼W |
| 130 | Resistor | 470 ½W |
| 131 | Resistor | 47 ½W |
| 142 | Resistor | 1K ¼W |
| 147 | Resistor | 1K ½W |
| 148 | Resistor | 2.2M ¼W |
| 150 | Resistor | 2.2M ¼W |
| 151 | Resistor | 100K ¼W |
| 155 | Resistor | 100 ¼W |
| 157 | Resistor | 100K ¼W |
| 158 | Resistor | 1M ¼W |
| 51 | Speaker, electromagnetic | 10W at 2500 Hz |
| 134 | Transformer, saturating ferrite core with three push-pull windings | 12V input at 300V output) 2500Hz |
| 161 | Transformer, pulse | 300V input 5KV output |
| 128 | Transistor, programmable unijunction PNPN | 1A 40V such as 2N6027 |
| 152 | Transistor, programmable unijunction PNPN | 1A 40V such as 2N6027 |
| 135 | Transistor, silicon bipolar NPN | 4A 45V such as 2N6121 |
| 136 | Transistor, silicon bipolar NPN | 4A 45V such as 2N6121 |

TABLE 1-continued

| REF. NO. | CIRCUIT ELEMENT | VALUE OR CHARACTERISTICS |
|---|---|---|
| 153 | Thyristor | 1.6A 300V such as 2N1599 |

The operation of the apparatus may be summarized as follows. If not already supplied with batteries the base 15 is removed by removal of screws 18 to place batteries in the alarm. Normally six "D" type batteries will be employed. As previously described it may be desired to secure the alarm to a wall or a fixed or heavy object; this is, of course, not necessary for operation of the device.

When the base 19 is replaced on the unit with the batteries in position it should be turned to the OFF position with key switch 21. Turning the key switch 21 to the TEST position then operates the siren at a low level and also the visible flashlamp alarm. Following the test the alarm may be turned to the OFF position or to the ON position. When the alarm is turned to the ON position it is armed. Key 23 should be removed from the switch and placed in an accessible but inconspicious place. When the alarm is armed it may be activated by pushing on button 22 after which it can only be deactivated by placing key 23 in key switch 21 and turning it to the OFF position.

In addition to variations and modifications to the apparatus which have been described or suggested other variations will be apparent to those skilled in the art, and accordingly the scope of the invention is not to be deemed limited to the particular embodiment and its modifications shown or described but is rather to be determined by reference to the claims.

What is claimed is:

1. Visible and audible alarm apparatus comprising
- a loud speaker having a horn with an opening of annular cross-section,
- a transparent element shaped and positioned to form an extension of the inner wall of said annular cross-section opening,
- a flash lamp,
- means for mounting said flash lamp within said transparent element,
- a transparent lens structure enclosing the opening of said loud speaker and said transparent element,
- a battery, an audio frequency inverter circuit powered from said battery, said inverter circuit including a latching semiconductor switching circuit and a remotely operable switch, said latching circuit being arranged to latch on upon opening of said switch, and said switch being a normally closed switch, said inverter being connected to supply power to said loud speaker,
- a high voltage transformer,
- said inverter being connected to the primary of said high voltage transformer,
- a rectifier connected to rectify the output from the secondary of said high voltage transformer,
- a capacitor connected to receive a charge from said rectifier thereby storing energy,
- a pulse trigger circuit connected to trigger said flash lamp at intervals of a fraction of a second, and
- said flash lamp being connected to receive the energy stored in said capacitor to produce a light pulse upon each operation of said trigger circuit.

2. Apparatus as claimed in claim 1 wherein said remotely operable switch is a push button switch having its contacts connected to said switching circuit by a pair of conductors.

3. Apparatus as claimed in claim 1 further including an electrical impedance element and a key switch having a first position which disconnects said audio frequency inverter circuit from said battery, a second position which connects said inverter circuit to said battery and a third position which places said electrical impedence element in series with said loud speaker to reduce the electrical energy supplied thereto.

4. Visible and audible alarm apparatus comprising
- a loud speaker having a horn with an opening of annular cross-section,
- a transparent element shaped to form an extension of the inner wall of said annular cross-section opening,
- a flash lamp,
- means for mounting said flash lamp within said transparent element,
- an audio frequency signal generator powered from said battery connected to supply power to said loud speaker,
- a high voltage transformer,
- means for connecting the primary of said high voltage transformer to a source of alternating current,
- a rectifier connected to rectify the output from the secondary of said high voltage transformer,
- a capacitor connected to receive a charge from said rectifier thereby storing energy, and
- a pulse trigger circuit connected to trigger said flash lamp at intervals of not more than about a second, said flash lamp being connected to receive the energy stored in said capacitor to produce a light pulse upon each operation of said trigger circuit.

5. Apparatus as claimed in claim 4 wherein said signal generator includes a latching semi-conductor switching circuit and further including a push button switch having its contacts connected to said switching circuit by a pair of conductors.

6. Apparatus as claimed in claim 4 further including an electrical impedence element and a key switch having a first position which disconnects said audio frequency signal generator from said battery, a second position which connects said signal generator to said battery and a third position which places said electrical impedance element in circuit relation with said loud speaker to reduce the electrical energy supplied thereto.

7. Visible and audible alarm apparatus comprising
- a loud speaker,
- a battery, a flash lamp,
- an audio frequency inverter circuit powered from said battery,
- said inverter being connected to supply power to said loud speaker,
- a high voltage transformer,
- said inverter also being connected to the primary of said high voltage transformer,
- a rectifier connected to rectify the output from the secondary of said high voltage transformer,
- a capacitor connected to receive a charge from said rectifier thereby storing energy, and
- a pulse trigger circuit connected to trigger said flash lamp, said flash lamp being connected to receive the energy stored in said capacitor to produce a light pulse upon each operation of said trigger circuit.

8. Apparatus as claimed in claim 7 further including a latching semi-conductor switching circuit controlling power to said inverter circuit and a remotely operable normally closed switch, said latching circuit being arranged to latch on upon opening of said switch.

9. Apparatus as claimed in claim 8 wherein said remotely operable switch is a push button switch having its contacts connected to said switching circuit by a pair of conductors.

10. Apparatus as claimed in claim 8 further including an electrical impedance element and a key switch having a first position which disconnects said audio frequency inverter circuit from said battery, a second position which connects said inverter circuit to said battery and a third position which places said electrical impedence element in circuit relation with said loud speaker to reduce the electrical energy supplied thereto.

11. Apparatus as claimed in claim 7 wherein said loud speaker has a horn with an opening of annular cross-section and further including a transparent element shaped to form an extension of the inner wall of said annular cross-section opening and means for mounting said flash lamp within said transparent element.

12. Apparatus as claimed in claim 11 further including a transparent lens structure enclosing the opening of said loud speaker and said transparent element.

* * * * *